US005645091A

United States Patent [19]

Hoeft

[11] Patent Number: 5,645,091

[45] Date of Patent: Jul. 8, 1997

[54] APPARATUS FOR SOAKING AND PRESERVING PAINT ROLLER COVERS IN WET SUSPENSION IN A RECEPTACLE

[76] Inventor: Dale E. Hoeft, 24 Fowler St., Randolph, Mass. 02368

[21] Appl. No.: 604,892

[22] Filed: Feb. 22, 1996

[51] Int. Cl.[6] ..... B08B 9/02

[52] U.S. Cl. ..... 134/84; 134/135; 134/170; 134/900; 134/104.2; 206/209; 206/15.2; 206/362

[58] Field of Search ..... 134/88, 900, 135, 134/84, 52, 170, 171, 104.2, 104.3, 104.4; 68/213; 206/209, 209.1, 361, 362, 15.2; 422/300

[56] References Cited

U.S. PATENT DOCUMENTS

| | | | |
|---|---|---|---|
| 620,565 | 3/1899 | Burke et al. | 134/155 |
| 1,461,618 | 7/1923 | Hopkins | 206/209 |
| 1,610,186 | 12/1926 | Verville | 134/171 |
| 1,667,044 | 4/1928 | Oddo | 206/362 |
| 1,758,537 | 5/1930 | Rakestraw | 134/171 |
| 1,951,099 | 3/1934 | Meyerson | 422/300 |
| 2,029,844 | 2/1936 | Tyley | 134/171 |
| 2,127,682 | 8/1938 | Ewing | 206/209 |
| 2,141,516 | 12/1938 | Clements | 134/170 |
| 2,162,228 | 6/1939 | Pierce | 134/171 |
| 2,316,145 | 4/1943 | Futrell | 422/300 |
| 2,435,807 | 2/1948 | Udell | 134/170 |
| 2,704,931 | 3/1955 | Zelkowitz | 68/213 |
| 2,766,603 | 10/1956 | Zelkowitz | 68/213 |
| 3,918,582 | 11/1975 | Wallace | 206/362 |
| 3,964,926 | 6/1976 | Westphal | 134/135 |
| 4,310,010 | 1/1982 | Svoboda | 134/92 |
| 4,334,416 | 6/1982 | Turano | 68/213 |
| 4,448,209 | 5/1984 | Lindsay | 134/900 |
| 4,533,044 | 8/1985 | Ban | 206/15.2 |
| 4,544,529 | 10/1985 | Hoeck | 422/300 |
| 4,852,833 | 8/1989 | Lockwood | 248/110 |
| 5,507,060 | 4/1996 | Quimpo | 134/170 |

FOREIGN PATENT DOCUMENTS

| | | | |
|---|---|---|---|
| 2492323 | 4/1982 | France | 206/209 |
| 3007252 | 9/1981 | Germany | 206/209 |
| 3-69438 | 3/1991 | Japan | 206/362 |
| 6091 | 12/1904 | United Kingdom | 422/300 |

*Primary Examiner*—Frankie L. Stinson
*Attorney, Agent, or Firm*—Louis J. Franco

[57] ABSTRACT

An apparatus for soaking and preserving several paint roller covers in wet suspension in a receptacle comprising a rack on which several easily removable paint roller covers are positioned in spaced relationship. The apparatus provides economical cost saving use of paint rollers, convenience, time saving and ecological advantages whereby no washing or rinsing is necessary, from a faucet or hose, for instance, thereby conserving water. The resulting apparatus allows a person the capability of extending the useful life of a paint roller covers by preserving used paint roller covers and rejuvenating them for further use.

17 Claims, 4 Drawing Sheets

APPARATUS FOR SOAKING AND PRESERVING PAINT ROLLER COVERS IN WET SUSPENSION IN A RECEPTACLE

FIELD OF THE INVENTION

This invention relates generally to an apparatus for soaking and preserving paint roller covers n wet suspension in a container or receptacle, and more particularly to a support structure or rack for conveniently holding paint roller covers that, when positioned in a receptacle having a liquid, keeps the paint roller covers preserved in wet suspension, thereby extending their useful life until needed for further use.

BACKGROUND OF THE INVENTION

A popular painting tool is a roll-type applicator commonly known as a paint roller. Typically, a paint roller holder having a handle and a rotatably mounted spindle is fitted into a fabric sleeve or cover which is commonly referred to as a paint roller (hereinafter "roller cover" or "paint roller cover"). Paint roller covers, after use with either oil based paint or with latex paint, must be properly cleaned and stored between uses. If one fails to properly clean or store such paint roller covers, they usually cannot be reused and must be discarded, thereby creating additional expense and loss of time, particularly for industrial and commercial painting contractors.

Although it is desirable to properly clean a paint roller cover after each use if it is to be reused, this is often impractical, time consuming and messy, especially for frequent intermittent multiple roller cover interchanging which is often necessary when several crews of professional painters are painting a large building, for example. Typically, a paint roller cover, while laden with paint, is placed in a receptacle, such as a metal paint can or plastic bucket, which is partially filled with a liquid, usually water. Paint roller covers are placed in such a receptacle in a random manner. Paint roller cover crowding in such receptacles causes the paint from one roller cover, by direct contact, to mix with the paint on other roller covers and also may cause crushing and possible distortion of the fabric material on the paint roller covers, thereby resulting in a poor application of paint upon reuse. Normally, the paint on the paint roller covers settles to the bottom of the receptacle and forms a sludge and residue which can contaminate the paint roller covers to such an extent that they are rendered unusable. Therefore, it can be appreciated that the manner in which the paint roller cover is stored and cared for in wet suspension is critical to extending the life of the paint roller cover.

An alternative and better means for overcoming the shortcomings of previously mentioned methods of preserving paint roller covers in wet storage and suspension is provided by an apparatus that utilizes a rack on which several easily removable paint roller covers are positioned for soaking and preserving in a liquid-filled receptacle. When the rack is installed in a receptacle filled with liquid, the paint roller covers are retained in spaced relationship with the receptacle walls and each other, thereby soaking and preserving the paint roller covers until they are ready for reuse. The use of such a rack eliminates the problems associated with other wet storage techniques and devices. Also, installation and removal of the paint roller covers so stored can be accomplished without having to touch the paint rollers with one's hand.

Other advantages of preserving paint roller covers in wet suspension with the apparatus that utilizes a support structure or rack of the type described include economical, cost saving, and prolonged use of paint roller covers; convenience; time saving and ecological advantages whereby minimal or no washing or rinsing is necessary from a faucet or hose, for instance, which conserves water.

The applications and advantages noted above are preferably accomplished by an apparatus that is convenient to use and simple to manufacture. A limited number of paint roller cover wet storage devices have been devised for a variety of applications, but not specifically for economically, conveniently and cost effectively soaking and storing several paint roller covers in wet suspension with the desired features and advantages that the mentioned apparatus utilizing the rack has. Several examples of prior attempts are discussed below.

U.S. Pat. No. 3,918,582 to Wallace shows a container for soaking and preserving paint brushes and paint roller covers. Wallace discloses a wire support placed in a specially designed container with a screw-fitted cap for supporting one or more paint roller covers and/or one or more paint brushes above a space designed for collecting paint sediment at the bottom of the container below the brushes and/or roller covers. Among the most notable disadvantages of the invention disclosed in Wallace is that there is no means provided for maintaining paint roller covers in spaced relationship with one another and with the interior surface of the container; paint roller covers placed inside the Wallace apparatus are free to contact and stick to one another and/or the interior surface of the container.

U.S. Pat. Nos. 2,766,603 and 2,704,931 to Zelkowitz disclose a cylindrical mandrel in a container for cleaning and storing paint roller fabric sleeves. The devices disclosed in these patents rely on specially designed containers having formed housings and chambers with cylindrical mandrels having diameters closely approximating the inner diameter of a paint roller cover. Also, U.S. Pat. No. 2,704,931 to Zelkowitz requires direct handling contact with the wet paint roller by hand in order to remove the paint roller sleeve from the container. In addition, the inventions disclosed in U.S. Pat. No. 2,766,603 and in U.S. Pat. No. 2,704,93 do not permit a roller cover sleeve to be simply dropped over a post.

U.S. Pat. No. 4,334,416 to Turano shows a container for soaking and cleaning a paint roller sleeve which is fitted over a central post. The post has an enlarged foot for engaging the inside bottom of the receptacle so that the post is held stationary within the receptacle.

U.S. Pat. No. 4,852,833 to Lockwood shows a frame-like structure for holding paint brushes for cleaning when fitted into a paint bucket.

None of the Patents cited above discloses a means for maintaining two or more paint roller covers in spaced relationship with each other and with the interior surfaces of the container.

Accordingly, there is a great need for an apparatus that can conveniently and practically preserve several paint rollers in wet suspension in a receptacle at a low cost. Such a device therefore is preferably manufactured at a low cost and is simple to assemble and use.

SUMMARY OF INVENTION

It is therefore an object of this invention to provide an apparatus that can conveniently and practically soak and preserve several paint roller covers in wet suspension in a receptacle at a low cost.

It is also an object of this invention to provide an apparatus having a rack that can maintain the paint roller covers mounted thereon in spaced relationship with each other and with the walls of the receptacle when in wet suspension.

It is a further object of this invention to isolate paint roller covers from each other and from paint sediment and sludge that resides at the bottom of the receptacle so that the roller covers will not be contaminated by such residue thereby making them reusable rather than having to discard them because of accumulated paint residue.

Another object of this invention is to provide a means for positioning paint roller covers on the rack in the receptacle without touching the paint roller covers or the liquid with a human hand.

Another object of this invention is to provide a means for removing paint roller covers from the rack in the receptacle without touching the paint roller covers or the liquid with a human hand.

A further object of this invention is to provide conservation of water or whatever other liquid is used to soak and preserve the paint roller covers.

A further object of this invention is to encourage ecologically responsible disposal of paint residue precipitating out of the paint roller covers and settling at the bottom of the receptacle during the treatment of the roller covers.

It is also an object of this invention to provide an apparatus that is simple in design, simple to manufacture and, consequently, inexpensive to develop.

This invention results from the realization that there is a great need for an efficient, convenient, practical, low cost and versatile apparatus for simultaneously storing and preserving several paint roller covers in spaced relationship in wet suspension. The resulting apparatus provides a person the capability of extending the useful life of paint roller covers by rejuvenating them for future repeated use.

The above and the other objects are achieved in accordance with the present invention which, according to a first aspect, provides an apparatus for soaking and preserving paint roller covers in wet suspension in a receptacle having an open top and bottom and side walls for containing a quantity of liquid A roller cover storage rack is provided that is adapted to be inserted within the receptacle. Other aspects of the invention provide for a removable closure means such as a cap, lid, or other cover to alternately open and seal the open top of the receptacle and, in those instances when a closure means is provided, the rack is designed so as not to interfere with the sealing of the receptacle by the closure means. In the first aspect of the invention, a base portion is provided that has a plurality of upwardly extending rods, posts, shafts or other protrusions (hereinafter "rods") connected thereto for receiving paint roller covers thereon. Each rod is small enough in diameter to receive a paint roller cover thereover for soaking and preserving thereon. In the first aspect of the invention, a means is provided for maintaining the paint roller covers in spaced relationship with one another and with the interior surface of the walls of the receptacle which means may include spacing the rods far enough apart on the base portion from one another and from the interior surfaces of the receptacle so as to prevent the movement of the paint roller covers into contact with one another and with the interior surfaces of the receptacle. Where the spacing of the rods on the base portion is relied upon as the means for maintaining the roller covers in spaced relationship with one another and with the interior surfaces of the receptacle, it will be apparent to one skilled in the art that the thinner the rods are, the greater the distance between them will have to be to achieve the desired result. Other means for maintaining the roller covers in spaced relationship with one another and the interior surfaces of the receptacle may include seats attached to the base portion or rods at or near the bottom of the rods for fitting the roller covers thereover. The first aspect of the invention further provides a means for supporting the paint roller covers above the bottom wall of the receptacle so that there is a paint sediment settling space below the roller covers when they are positioned for soaking and preserving on the rack. Such means may include having a base portion that will permit paint sediment drainage therethrough such as an open web structure, aring, a grate, a grid, a mesh or any surface having a plurality of apertures therein. In this first aspect, the entire base portion is elevated above the bottom wall of the receptacle by supporting means such as leg elements fixedly connected to and downwardly extending from the base portion or suspension straps, bars or hooks cooperating with the base portion and the receptacle. Alternatively, the means for supporting the roller covers above the bottom of the receptacle may include providing each upwardly extending rod with a roller cover support which is connected to the rod at a point above the base portion. In this configuration, the base portion could be solid (i.e., lacking apertures or holes) and the paint sediment settling space could be between the base portion and the bottom of the roller cover supports. The roller cover supports on the upwardly extending rods may include a substantially horizontal bar, mesh, screen, grid or other configuration that will permit paint sediment to fall below the roller cover support while supporting the paint roller cover.

According to a second aspect of the invention, a roller cover storage rack is provided for soaking and preserving paint roller covers in wet suspension in a cylindrical receptacle. Furthermore, the second aspect also provides a roller cover storage rack with a base portion. In this aspect, however, the base portion includes a plurality of radially extending arms that originate from a center point and extend outwardly toward the interior surface of the cylindrical side wall of the receptacle. It will be apparent to one skilled in the art that the radially extending arms are shorter than the interior radius of the cylindrical receptacle so that the rack will fit into the receptacle. Further, the second aspect provides for a vertical center post having upper and lower ends that is fixedly connected at its lower end to the base portion at the point from which the radially extending arms originate. In all other respects, the second aspect of the invention is the same as the first aspect of the invention; the second aspect is a special case of the first aspect.

In a third aspect of the invention, a roller cover storage rack of the type described in the first and second aspects is disclosed. The difference in the third aspect is that no container or receptacle is provided. These racks can be constructed in differing dimensions to fit inside any number of standard size commercially available containers such as one, two, and five gallon capacity containers, for example.

BRIEF DESCRIPTION OF DRAWINGS

Other objects, features, and advantages of this invention will occur to those skilled in the art from the following description of a preferred embodiment and the accompanying drawings, in which.

Referring now to the drawings and in particular to FIG. 1, there is shown a sectional view of the preferred embodiment of the apparatus for preserving paint roller covers in wet suspension in a container.

DISCLOSURE OF THE PREFERRED EMBODIMENT

Figure 1:
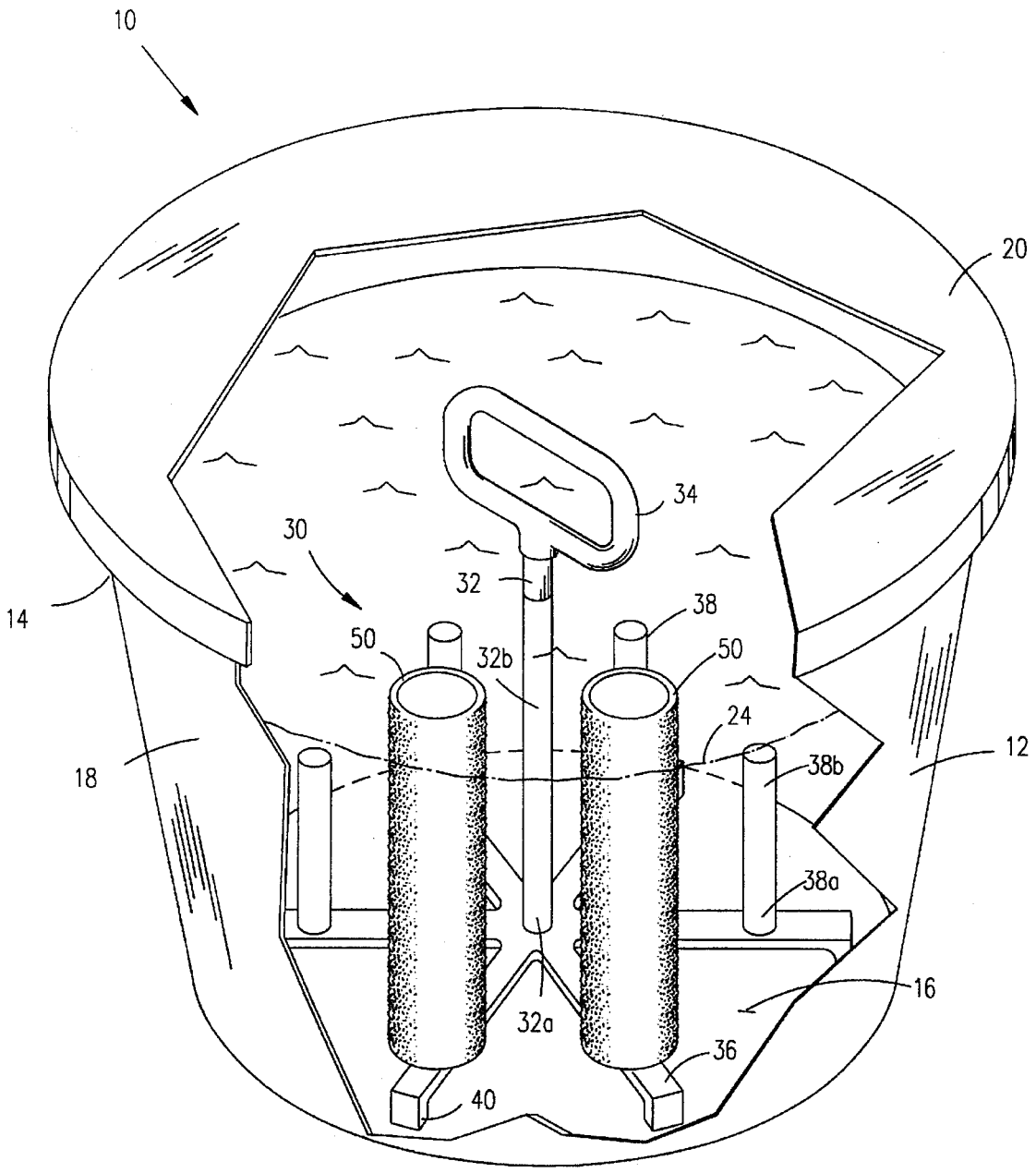

There is shown in FIG. 1 a sectional view of an apparatus 10 according to a preferred embodiment of the present invention. Apparatus 10 comprises a roller cover storage rack 30 for receiving paint roller covers 50 in combination with a receptacle 12 for receiving a liquid 24. Rack 30 has a center post 32, a plurality of arms 36, a plurality of rods 38 and a means for maintaining rack 30 in spaced relationship with bottom wall 16 of receptacle 12 so that paint sediment can settle in paint sediment settling space 44 while keeping paint roller covers 50 away from the settled sediment. Arms 36 are fixedly attached and perpendicular to center post 32 ant extend radially outward from center post 32. Rods 38 are fixedly attached to and spaced apart on arms 36 Rods 38, extend vertically upward to a point below the open top 14 of receptacle 12. Rods 38 receive paint roller covers 50 for immersing in liquid 24, preferably water, and restrain the roller covers 50 from contacting each other, center post 32 and side walls 18 Although not needed, receptacle 12 may be provided with a cover 20 as well as a grip 22 (not shown in FIG. 1, see FIG. 4).

The initial fill of liquid 24 in receptacle 12 may be used more than once, without refilling, to soak and preserve paint roller covers 50 as required. Periodically, a small quantity of make up liquid 24 may be added to replace the liquid 24 lost to evaporation and normal absorption by paint roller covers 50 to ensure that paint roller covers 50 are fully immersed in the liquid 24, but no paint roller rinsing from hoses or disposal of paint in sinks is necessary, thereby conserving water and preserving the ecology.

During use, cover 20 can be placed on receptacle 12 to prevent spillage due to vibration and agitation occurring during transportation in a vehicle. Furthermore, the vibration and agitation caused by the movement of a vehicle will enhance cleaning by accelerating the rate at which paint is removed from paint roller covers 50. Also, cleaning of the roller covers 50 may be further accelerated by the user through repeated lifting and lowering of rack 30 in receptacle 12 to provide some additional agitation and draining prior to re-use. Excess liquid 24 is typically spun out of a paint roller cover 50 by use of a commercially available painting accessory such as a spinner (not shown).

After prolonged use of the apparatus 10, paint residue and sludge eventually build up and collect on the bottom 16 and in space 44 of receptacle 12 such that they would eventually contaminate paint roller covers 50. When necessary, rack 30 with paint roller covers 50 thereon is simply lifted out of receptacle 12 and is inserted into another clean receptacle 12. The liquid 24 may be recycled, and thereby conserved, by pouring it into the clean receptacle 12 leaving behind the paint residue deposited in the bottom 16 of first receptacle 12 which is put aside and allowed to air dry. After the paint in first receptacle 12 has dried, it is removed from walls 18 and bottom 16 of receptacle 12 and may be properly disposed of, thereby making first receptacle 12 ready to receive another roller cover storage rack 30 and paint rollers covers 50.

Figure 2:
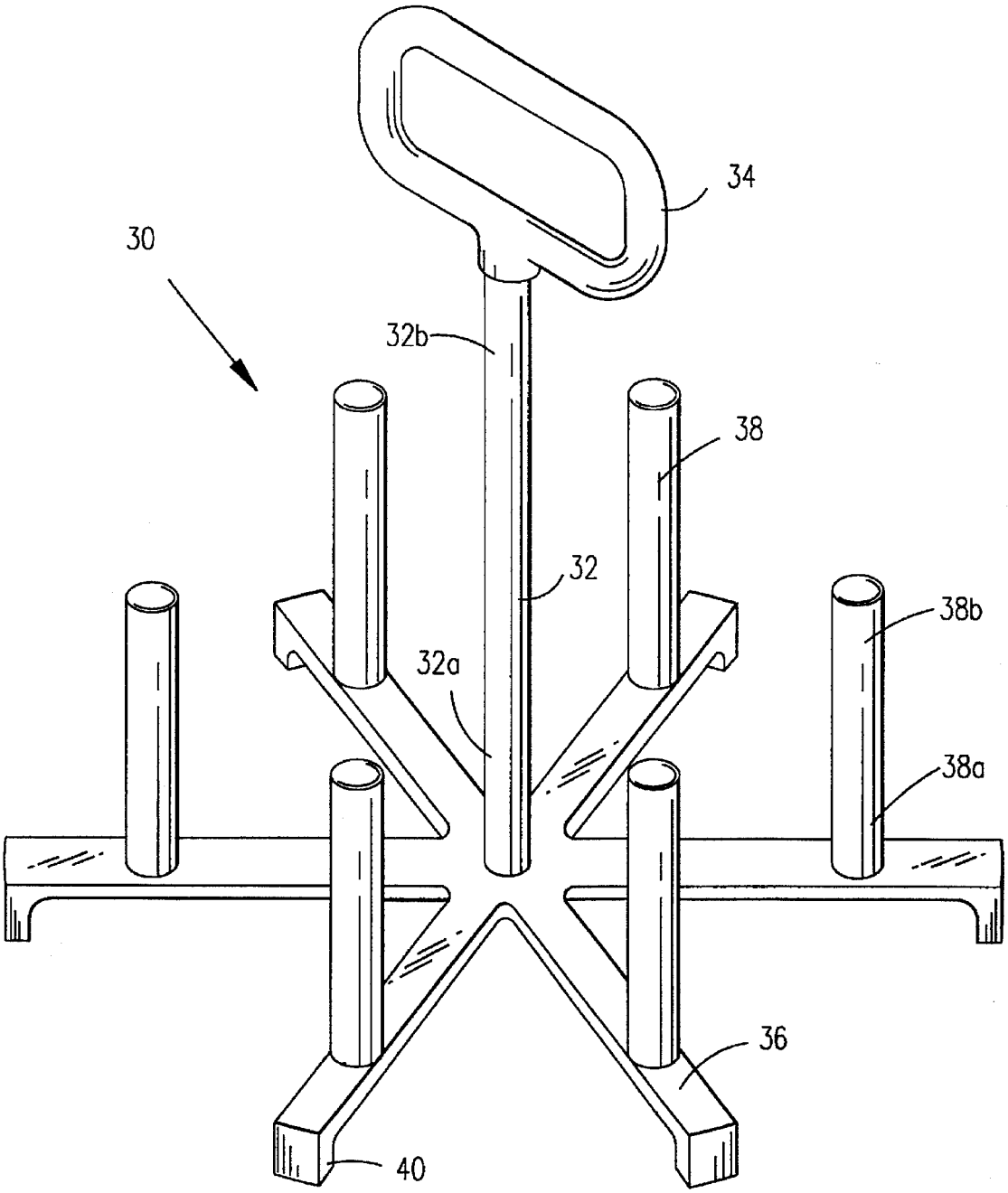
FIG. 2 is a perspective view of the rack of FIG. 1.

FIG. 2 is a perspective view of the roller cover storage rack 30. Rack 30 has a center post 32, a plurality of arms 36, a plurality of rods 38, and a plurality of leg elements 40 extending downwardly from arms 36. Arms 36 are fixedly attached and perpendicular to a lower end **32*a* of center post 32 and extend radially outward from center post 32. Rods 38 are fixedly attached to and spaced apart on arms 36. Rods 38 each have an upper end 38*b* and a lower end 38*a* and extend vertically upward to a point below an upper end 32*b* of center post 32. Center post 32 may have a handle 34 either integrally formed with center post 32 or separately attached to upper end 32*b*. Preferably, rack 30 is constructed from a non-corrosive material such as plastic. Also, stainless steel, aluminum or ferrous metals can be used. Anodized aluminum can be utilized to further enhance appearance and to form an additional barrier to corrosion. Furthermore, ferrous metals, if used, may be coated or dipped with paint, epoxy, plastic or rubber to minimize corrosion and to extend the useful life of rack 30. Preferably, rack 30 is molded from plastic or cast in metal. Also, rack 30 can be fabricated, for example, from metal components such as rods, bars, or tubes and the component parts joined by welding, threading, gluing, screwing or any other commonly available means for joining component pans. Alternately, rack 30 may be made by forming and bending metal into the desired shape, joining the components together, by welding for example, and coating the rack 30** with a suitable protective material such as the ones mentioned above.

Figure 3:
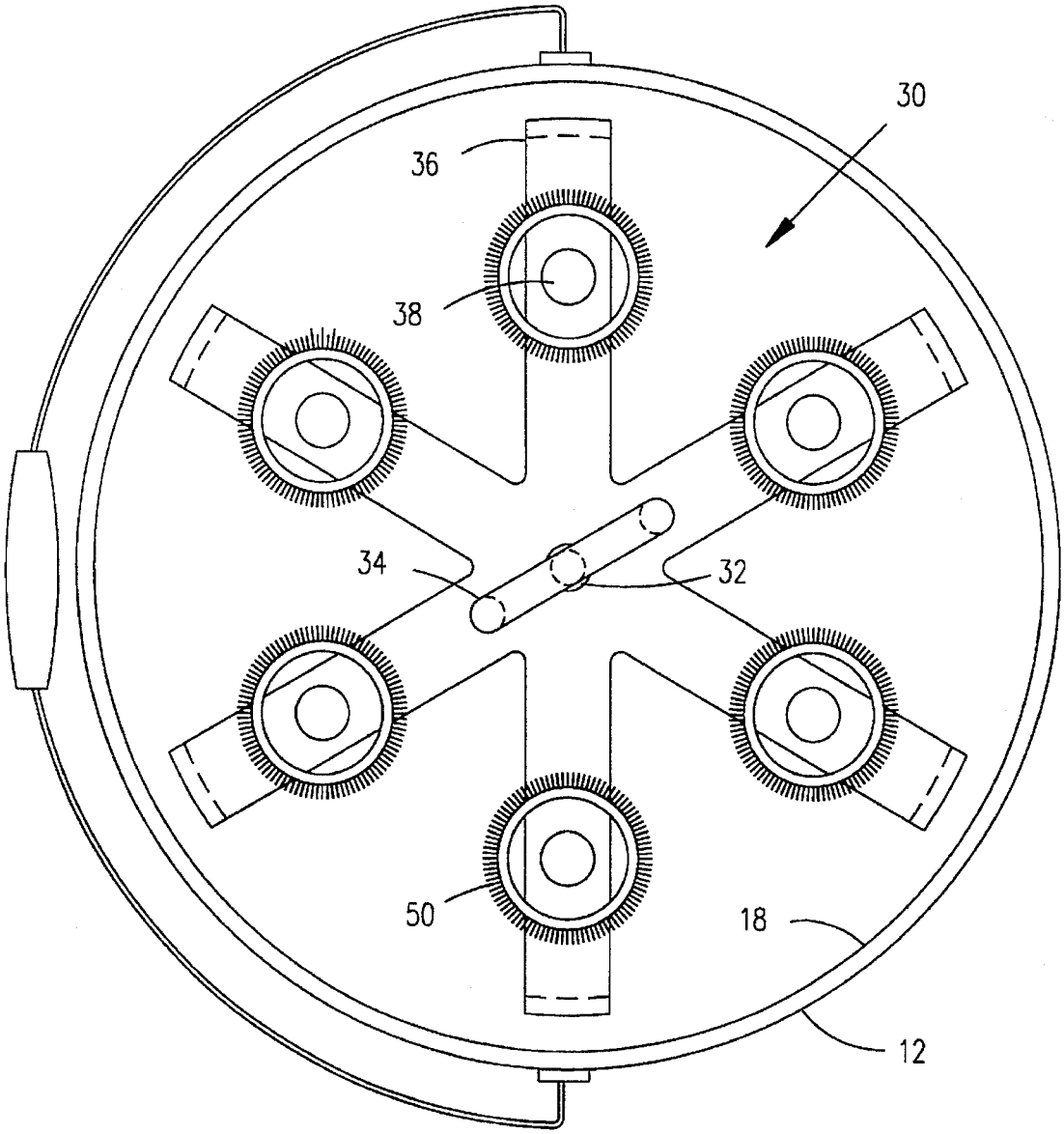
FIG. 3 is a top view of the rack of FIG. 2 with six paint roller covers in a receptacle.

FIG. 3 is a top view of the rack 30 of FIG. 2 with six paint roller covers 50 in a receptacle 12. Receptacle 12, preferably is a readily available, plastic, 5 gallon paint container commonly used by painting contractors and others. Rack 30 is shown installed in receptacle 12 with six paint roller covers 50 thereon. Each paint roller cover 50 is positioned on a rod 38 and is resting on an arm 36. One manner in which this can be accomplished is by placing each paint roller cover 50 on rack 30 and grasping handle 34 and lowering rack 30 into receptacle 12 which is filled with a liquid. Each paint roller cover 50, so positioned on rack 30, is spaced away from side walls 18 of receptacle 12 by rods 38 which are fixedly attached to and are spaced on arms 36 The preferred spacing of rods 38 on arms 36 acts to restrain paint roller covers 50 from contacting each other, center post 32 and side wall 18 while maximizing the number of roller covers 50 that can be placed on rack 30.

Figure 4:
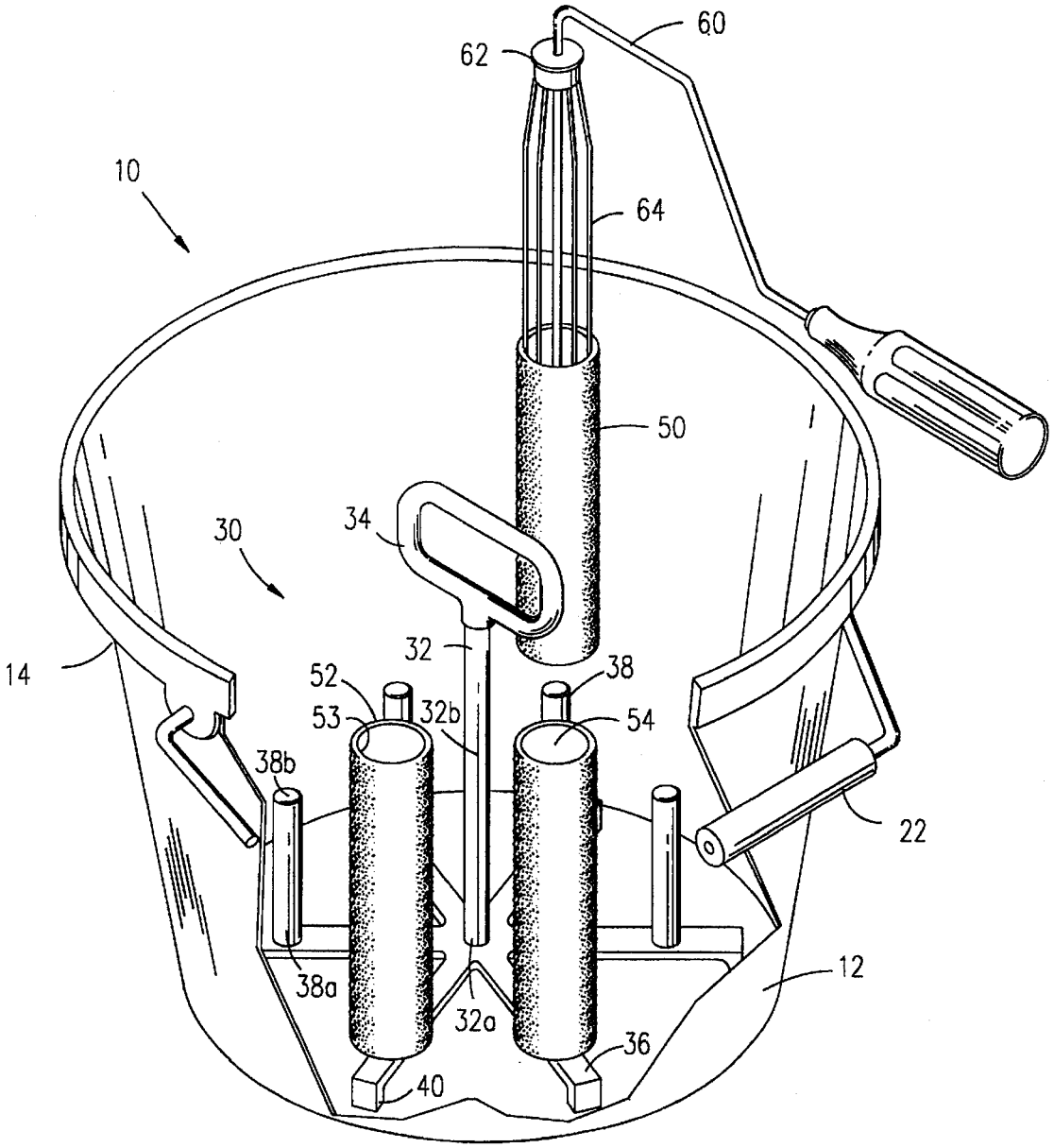
FIG. 4 illustrates removal or installation of a paint roller cover from or onto the rack of the instant invention using a conventional paint roller holder.

FIG. 4 illustrates how a paint roller cover 50 may be removed or installed from or onto rack 30 in receptacle 12 that is filled with liquid 24 (not shown in FIG. 4) without having to contact the liquid 24 or the paint roller cover 50 with one's hand. After paint roller covers 50 have been preserved in wet suspension in receptacle 12 and are ready for removal for re-use, a user simply inserts one end of spindle 62 of a conventional paint roller holder 60 into core 52 through open top 54 of paint roller cover 50 until bow springs 64 of spindle 62 frictionally engage interior cylindrical surface 53 of roller cover 50 thereby permitting it to be lifted and removed from receptacle 12. Each rod 38 of rack 30 is shorter in length than paint roller cover 50 by an amount sufficient to permit insertion of spindle 62 of paint roller holder 60 through open top 54 far enough into core 52 of roller cover 50 to permit frictional engagement of bow springs 64 with interior cylindrical surface 53 of roller cover 50 for easy removal from rack 30 without having to touch paint roller cover 50 by hand and without having to lift rack 30 via handle 34 to access paint roller covers 50. If desired, however, rack 30 may be lifted out of receptacle 12 via handle 34 to drain liquid from the paint roller covers 50, but this is not necessary. After paint roller cover 50 is partially engaged on paint roller holder 60, paint roller 50 may be fully positioned on bow springs 64 of spindle 62 by positioning open bottom end 56 of paint roller cover 50 on the rim portion of the open top 14 of receptacle 12 or by pushing against any surface or object that provides sufficient resistance, and pushing firmly against such bearing surface until the paint roller cover 50 is urged into full engagement with spindle 62. This process for removing paint roller covers 50 can be achieved equally as well by inserting the spindle portion of a spinner into core 52 of open top 54 of paint roller cover 50 until frictional engagement is achieved in the same manner as described in connection with the roller holder 60.

To install a paint laden paint roller cover 50 onto rack 30, roller cover 50 must be removed from paint roller holder 60. This is accomplished by placing paint roller holder 60 with paint roller cover 50 over an upper end **38*b* of rod 38, and, using an ordinary screwdriver or other tool, slidably urging open top 54 of paint roller cover 50 over an upper end 38*b* of rod 38 until the paint roller cover 50 is frictionally disengaged from bow spring 64 of spindle 62 without having to touch paint roller cover 50 by hand and without having to lift rack 30 via handle 34 to install paint roller 50 on rack 30**.

Rack 30 may be lifted out of receptacle 12 via handle 34 or by grasping upper end **32*b* of center post 32 to drain liquid from the paint roller covers 50, although it is not necessary. However, for periodic cleaning, removal of rack 30 from receptacle 12 is readily accomplished. Similarly, rack 30 may be quickly installed in any receptacle or easily transferred to another receptacle such as, for example, a commonly available 5 gallon paint container. Furthermore, rack 30** is readily adaptable to any available receptacle of any size.

EXAMPLE

A working prototype has been constructed in accordance with the invention disclosed herein.

Using metal rods of the type used for welding, a rack for preserving paint roller covers in wet suspension in a receptacle was fabricated entirely from available lengths of ¼" diameter weld rods. The weld rods were cut to size to create the components necessary to form the rack, namely arms, rods, a center post, and downwardly extending leg elements. The finished rack was designed and constructed to hold six (6) 9 inch, standard paint roller covers in an open-web radial array so that the rack would fit into a standard 5 gallon paint container commonly used by painting contractors and others without the paint roller covers contacting each other, the center post, or the interior surface of the container. Hence, the rack would fit into a simple container, filled with liquid, thereby eliminating the need and associated cost to design and provide a special container for accommodating the rack and paint rollers. Further, the rack was fabricated with legs to create a gap to prevent settled paint sludge and residue collecting on the bottom of the container from contacting the rollers while they were being soaked and preserved in wet suspension. In the prototype, the leg elements were formed from the rods by allowing the rods to extend slightly below the arms, about ¾ inch, to define a gap when the legs rested on the bottom of the container. Also, the rack was made to eliminate the need to touch the wet and paint laden paint roller covers with one's hand while installing or removing them from the rack while in the container.

After the components were cut to length, they were joined together in their relative positions by welding. A handle was formed by bending the upper end of the center post to provide a convenient holding means to permit installation and removal of the rack from the container. Dimensions of the rack were approximately 13 inches in height by 5 inches in radius with the height of the center post being about 12.25 inches off the plane defined by the radially extending arms. The rods were cut approximately 2 inches shorter than a standard paint roller cover, making them about 7 inches in length. The diameter of the rods(¼ inch) is much smaller that the interior diameter of the paint roller core, which is approximately 1.5 inches. This permits the paint roller covers to easily fit onto the rods to facilitate use. The top of the center post is below the open top of the container when the rack is placed therein. Also, the upper end of the center post and the formed handle are positioned above the open tops of the paint roller covers so that when the paint roller covers are submerged in liquid, the handle and the upper end of the center post are not submerged, so that the rack can be lifted without the user's getting his or her hand wet when lifting the rack out or placing into the container.

After using paint roller covers and latex paint for painting, the rack and the paint roller covers laden with latex paint were placed in a 5 gallon paint container which was filled with water to a depth sufficient enough to cover the top of the paint roller covers. The rack and paint roller covers were allowed to soak in the water for several days during which they were periodically inspected to see if they were being drained of wet latex paint. The invention, as tested by the inventor, fulfilled the objectives for which it was designed. Furthermore, it was discovered that while transporting the container and paint roller covers in a truck, the paint on the paint rollers was shaken off faster than when they were let to remain at rest due to the vibration and agitation imparted to the paint roller covers by the vehicle's motion Paint was observed to dislodge from the paint roller covers and was deposited in the space sediment settling space provided by the legs of the rack on the bottom of the container, out of contact with the paint rollers, as desired. It was found that paint residue and sludge eventually build up and collect on the bottom of the container such that, if not attended to, it would eventually contaminate the paint roller covers. Therefore, when necessary, the rack with paint roller covers thereon was simply lifted out of the container and inserted into another clean container. The water in the first container was recycled and thereby conserved by carefully pouring it into the clean container leaving behind the paint residue deposited in the bottom of the original container which was put aside and allowed to air dry. Later, the dried paint residue was removed from the container walls and bottom and was properly disposed of, making the original container ready to receive another rack and paint roller covers.

During testing, the initial fill of water in the container was used more than once, without refilling, to soak and preserve the paint rollers as required. Periodically, a small quantity of make up water was added to replace the water lost to evaporation and normal absorption by the paint roller covers to ensure that the paint roller covers were fully immersed in the water, but no paint roller rinsing or disposal of paint in sinks or from hoses was necessary, thereby conserving water and preserving the ecology.

To remove a paint roller cover from the rack and container, the spindle portion of a paint roller holder was placed over a rod having a paint roller installed thereover. The paint roller holder was positioned onto the open top of the core of the paint roller cover and partially pushed into the paint roller cover until the roller cover was held by the bow spring portion of the spindle of the paint roller holder by friction. This allowed lifting of the paint roller cover so that it could be completely seated onto the spindle by positioning the open end of the paint roller cover on the rim portion of the open top of the container and pushing firmly against such bearing surface until the paint roller cover was slidably urged into full engagement with the spindle. Excess water was spun out of the paint roller cover using a spinner prior to re-use of the roller cover.

Although specific features of this invention are shown in some drawings and not others, this is for convenience only, as some feature may be combined with any or all of the other features in accordance with this invention.

The foregoing is considered illustrative only of the principles of the invention. Furthermore, since numerous modifications and changes will readily occur to those skilled in the art, it is not desired that the foregoing limit the invention to the exact construction and operation shown and described. Accordingly, all suitable modifications and equivalents may be resorted to that appropriately fall within the scope of the invention. Other embodiments therefore will occur to those skilled in the art and are within the scope of the following claims:

What is claimed is:

1. An apparatus for soaking and preserving paint roller covers in wet suspension comprising:

an open top receptacle having bottom and side walls for containing a liquid;

a roller cover storage rack for removable insertion into said receptacle through said open top, said rack having a base portion, said base portion having a plurality of upwardly extending rods fixedly attached thereto, each said rod being small enough in diameter to receive a paint roller cover thereover for soaking and preserving;

means connected to said rack for supporting each roller cover to be soaked and preserved thereon such that the top of each roller cover, when in position for soaking and preserving, is higher than the top of each said rod around which it is to be soaked and preserved by an amount sufficient to permit the insertion of the spindle portion of a paint roller holder along the interior cylindrical surface of the roller cover until the interior surface of the paint roller cover frictionally engages the spindle portion of the paint roller holder so as to permit the removal of each paint roller cover from said rack in said receptacle without the need for contact by a user's hand;

means connected to said rack for maintaining the paint roller covers in spaced relationship with one another and with said walls of said receptacle so that paint sediment can fall away from the paint roller covers toward the bottom wall of said receptacle to a point below the paint roller covers; and means connected to said rack for supporting the paint roller covers above said bottom wall to define a paint sediment settling space between the bottom of the paint roller covers and said bottom wall so that the paint roller covers are out of contact with settled paint sediment while being soaked and preserved.

2. The apparatus of claim 1 wherein said base portion of said rack comprises an open web structure.

3. The apparatus of claim 2 wherein said supporting means comprises a plurality of leg elements fixedly connected to and downwardly extending from said base portion for supporting said rack above said bottom wall of said receptacle to provide said paint sediment settling space between said bottom wall and said base portion.

4. The apparatus of claim 1 wherein said maintaining means comprises connecting said upwardly extending rods to said base portion far enough apart from one another and from said walls of said receptacle so that the paint roller covers are restrained by said rods from contacting one another and said walls of said receptacle.

5. The apparatus of claim 1 further comprising a post fixedly attached to said base portion and upwardly extending therefrom, said post having upper and lower ends, said post being longer than the paint roller covers to be soaked and preserved so that when said receptacle is filled with a sufficient quantity of liquid to submerge the paint roller covers said upper end of said post extends above the liquid level so that a user can grasp said post for removing and inserting said rack into the liquid without having to contact the liquid by hand.

6. The apparatus of claim 5 further comprising a handle fixedly attached to said upper end of said post.

7. The apparatus of claim 1 further comprising a removable closure means for alternately sealing and opening said open top of said receptacle while the roller covers are being soaked and preserved on said rack within said receptacle.

8. An apparatus for soaking and preserving paint roller covers in wet suspension comprising:

an open top receptacle having a bottom wall and a cylindrical side wall for containing a quantity of liquid;

a roller cover storage rack for removable insertion into said receptacle through said open top, said rack comprising a vertically extending center post having an upper end and a lower end; a base portion fixedly attached to said lower end of said center post, said base portion having a plurality of radially extending arms fixedly attached to said lower end of said center post, said radially extending arms being perpendicular to said center post and shorter than the interior radius of said receptacle; a plurality of upwardly extending rods fixedly attached to said radially extending arms, each said rod having an upper end and a lower end, said upwardly extending rods being spaced such that said paint roller covers are restrained from contacting one another, said center post, and said cylindrical side wall of said receptacle, each said rod being small enough in diameter to receive one of the paint roller covers thereover for soaking and preserving thereon;

means connected to said rack for supporting each roller cover to be soaked and preserved thereon such that the top of each roller cover, when in position for soaking and preserving, is higher than the top of each said rod around which it is to be soaked and preserved by an amount sufficient to permit the insertion of the spindle portion of a paint roller holder along the interior cylindrical surface of the roller cover until the interior surface of the paint roller cover frictionally engages the spindle portion of the paint roller holder so as to permit the removal of each paint roller cover from said rack in said receptacle without the need for contact by a user's hand; and means connected to said rack for supporting the paint roller covers above said bottom wall to define a paint sediment settling space between the bottom of the paint roller covers and said bottom wall so that the paint roller covers are out of contact with settled paint sediment while being soaked and preserved.

9. The apparatus of claim 8 wherein said supporting means comprises a plurality of leg elements fixedly connected to and downwardly extending from said radially extending arms for supporting said rack above said bottom wall of said receptacle to provide said paint sediment settling space between said bottom wall and said base portion.

10. The apparatus of claim 8 wherein said center post is longer than the paint rollers to be soaked and preserved so that when said receptacle is filled with a sufficient quantity of liquid to submerge the paint roller covers so said upper end of said post extends above the liquid level so that a user can grasp said post for removing and inserting said rack into the liquid without having to contact the liquid by hand.

11. The apparatus of claim 10 further comprising a handle fixedly attached to said upper end of said post.

12. The apparatus of claim 8 further comprising a removable closure means for alternately sealing and opening said open top of said receptacle while the roller covers are being soaked and preserved on said rack within said receptacle.

13. A roller cover storage rack for soaking and preserving paint roller covers in wet suspension, said rack for removable insertion into a receptacle for containing a liquid, said rack comprising:

a base portion;

a plurality of upwardly extending rods fixedly attached to said base portion, each said rod being small enough in diameter to receive a roller cover thereover for soaking and preserving thereon;

means connected to said rack for maintaining the paint roller covers in spaced relationship with one another and with the interior surface of the receptacle so that paint sediment can fall unobstructed from the paint roller covers toward the bottom of the receptacle to a point below the roller covers;

means connected to said rack for supporting each roller cover to be soaked and preserved thereon such that the top of each roller cover, when in position for soaking and preserving, is higher than the top of each said rod around which it is to be soaked and preserved by an amount sufficient to permit the insertion of the spindle portion of a paint roller holder along the interior cylindrical surface of the roller cover until the interior surface of the paint roller cover frictionally engages the spindle portion of the paint roller holder so as to permit the removal of each paint roller cover from said rack in said receptacle without the need for contact by a user's hand; and means connected to said rack for supporting the paint roller covers above the bottom wall of the receptacle to define a paint sediment settling space between the bottom of the paint roller covers and the bottom wall so that the paint roller covers are out of contact with settled paint sediment while being soaked and preserved.

14. The apparatus of claim 13 further comprising a post fixedly attached to said base portion and upwardly extending therefrom, said post having upper and lower ends, said post being longer than the paint roller covers to be soaked and preserved so that when the receptacle is filled with a sufficient quantity of liquid to submerge the paint roller covers said upper end of said post extends above the liquid level so that a user can grasp said post for removing and inserting said rack into the liquid without having to contact the liquid by hand.

15. The roller cover storage rack of claim 14 wherein said base portion comprises a plurality of radially extending arms fixedly attached to the lower end of said post and perpendicular to said post.

16. The roller cover storage rack of claim 14 further comprising a handle fixedly attached to said upper end of said post.

17. The apparatus of claim 13 wherein said maintaining means comprises connecting said upwardly extending rods to said base portion far enough apart from one another and from the interior surface of the receptacle so that the paint roller covers are restrained by said rods from contacting one another and the receptacle.

* * * * *